US010280053B1

(12) United States Patent
Grunnet et al.

(10) Patent No.: US 10,280,053 B1
(45) Date of Patent: May 7, 2019

(54) HYDRAULIC POSITIONER FOR LARGE AND HEAVY WORK PIECES

(71) Applicant: ALM POSITIONERS, INC., Rock Island, IL (US)

(72) Inventors: Douglas Grunnet, Morris, IL (US); Colten Jay Brunenn, Aledo, IL (US); Robert Brian Doneth, Bettendorf, IA (US); Jacob Evan Hill, Davenport, IA (US)

(73) Assignee: Alm Positioners, Inc., Rock Island, IL (US)

( * ) Notice: Subject to any disclaimer, the term of this patent is extended or adjusted under 35 U.S.C. 154(b) by 0 days.

(21) Appl. No.: 16/017,124

(22) Filed: Jun. 25, 2018

(51) Int. Cl.

| | |
|---|---|
| ***B66F 11/00*** | (2006.01) |
| ***B66F 7/08*** | (2006.01) |
| ***B66F 9/18*** | (2006.01) |
| ***B66C 13/18*** | (2006.01) |
| ***B66C 1/42*** | (2006.01) |

(52) U.S. Cl.
CPC ..... *B66F 7/08* (2013.01); *B66C 1/427* (2013.01); *B66C 13/18* (2013.01); *B66F 9/18* (2013.01)

(58) Field of Classification Search
CPC ..... B66F 1/00; B66F 3/10; B66F 3/24; B66F 5/00; B66F 7/04; B66F 9/065
See application file for complete search history.

(56) References Cited

U.S. PATENT DOCUMENTS

| | | | | |
|---|---|---|---|---|
| 1,812,585 | A * | 6/1931 | Collins | B25H 1/0007 248/172 |
| 5,297,915 | A * | 3/1994 | Bach | B66F 5/04 248/676 |
| 6,273,215 | B1 * | 8/2001 | Horan | B66F 7/18 187/203 |
| 2001/0048188 | A1 * | 12/2001 | DuVernay | B25B 11/00 269/17 |
| 2011/0084245 | A1 * | 4/2011 | Penenburgh | B66F 3/18 254/2 R |
| 2011/0210298 | A1 * | 9/2011 | Bonacini | B66F 7/16 254/89 H |
| 2015/0232309 | A1 * | 8/2015 | Jaipaul | B66F 7/04 414/800 |
| 2015/0232310 | A1 * | 8/2015 | Jaipaul | B66F 3/46 414/800 |
| 2015/0369309 | A1 * | 12/2015 | Slee | B66F 9/06 269/17 |

* cited by examiner

*Primary Examiner* — Lee D Wilson
(74) *Attorney, Agent, or Firm* — McKee, Voorhees & Sease, PLC

(57) ABSTRACT

A heavy duty hydraulic positioner has headstock and tailstock carriages to support large and heavy work pieces to be processed in a manufacturing operation, such as robotic welding. Each carriage is independently movable along a column, and has a hard stop associated with each preprogram workpiece position, thereby providing accurate repeatability. Repeatability is further enhanced by linear, noncontact absolute encoders for the elevation axes of the headstock and tailstock, and rotary, noncontact absolute encoders for the rotary axes of the headstock and tailstock.

20 Claims, 9 Drawing Sheets

HYDRAULIC POSITIONER FOR LARGE AND HEAVY WORK PIECES

BACKGROUND OF THE INVENTION

Hydraulic positioners having a high weight capacity are well known for manufacturing operations, such as manual welding and manual assembly. For example, applicant's prior art positioners can elevate and rotate the workpiece at either the head or tail end, or both, with programmed work points having repeatability within +/−0.250 inch for each axis, thereby leading to a maximum repeatability variation of +/−0.750 inch relative to the programmed work point for the elevating headstock and tailstock with a rotary axis. This variability of the repeatability range is undesirable for automated procedures, such as robotic welding. Although these types of positioners are lower cost than traditional servo robotic positioners programmed point position variability limits their use for robotic manufacturing applications.

Applicant's prior art positioner utilizes a single acting hydraulic cylinder for each of the headstock and tailstock carriages. Starting from a "home" loading position, the workpiece is attached to a workpiece holding fixture mounted on the headstock and tailstock, which are then raised or lowered independently while maintaining a substantially horizontal plane between the opposite workpiece ends. Movement of the workpiece continues until the preprogrammed work position is achieved. A cable-actuated string potentiometer is used to measure linear position of the headstock and tailstock carriages and provides the PLC or control with the required programmed position information. After the workpiece is elevated, gravity provides the forced return of the headstock and the tailstock to the home position. Each headstock and tailstock carriage include a plurality of teeth as a safety precaution, in the event of hydraulic cylinder failure. If a cylinder failure or blowout occurs during positioner elevation or descent, a hinge plate mounted on the structures vertical column engages the horizontal surface of the carriages safety tooth immediately above the hinge plate.

The normal open position of the hinge plate is approximately 30 degrees from vertical and is pushed out of the way by the slopping tooth surfaces during elevation. During programmed descent a solenoid is actuated overcoming gravity and spring pressure of the normally open hinge position hinging the plate into a flat position against the structural columns internal surface. This allows gravity to safely descend the carriage and attached fixture/workpiece load to a lower programmed position.

The speed of the prior art positioner assent and descent is controlled and adjusted by the hydraulic cylinder pump on each headstock and tailstock via low and high flow valves. The fluid flow adjustment response to the position and speed information is provided by the string potentiometer. Smooth, controlled movement of the workpiece is preferred, even with unbalanced weight distribution. However, the choice of only a high or low flow rate can produce a halting, stepping motion. Since the high and low flow valves are either completely on or completely off, the motion control can be course or rough, and programmed can position variability can be +/−¼ inch. In addition, over time, the string potentiometer used for position information can lose tension and become constricted due to the manufacturing environment conditions which may undermine position precision.

The current prior art positioners of Applicant also use a hydraulically powered slew worm drive gearbox with a single or multidirectional proportional control valve to rotate each headstock or tailstock about the center axis. An encoder mounted on the worm drive shaft provides position and speed information to the PLC control system. The encoder mounted on the worm drive shaft is old. The new encoder is a non-contact absolute encoder type mounted on the rotation faceplate of the worm drive gearbox. Mounting the encoder on the work shaft end increases the range of programmed position repeatability, since such location is more remote from the workpiece and includes gear clearance variability, unbalanced loading, and any other mechanical variations up to the work slew drive mounting plate. The rotary programmed position repeatability is +/−0.250 inch.

Robotic welding processes often require positioning assemblies and subassemblies (parts/weldments), particularly for large, heavy parts and fixture combinations weighing 5,000-100,000 lbs. moving through the manufacturing process. Hydraulic positioners typically are not used for such robotic welding applications since these positioners do not return accurately to programmed positions. In robotic welding applications where electric servo motors are utilized, two axes positioning of the large heavy part and fixture combinations is accomplished using servo motor/gearbox sets for each positioning axis. The servo motor/gearbox set is programmable using a PLC or auxiliary axes of the robot to move the workpiece/fixture to a pre-programmed point typically within +/−0.008 inch. The ability of the positioner to return to the preprogrammed point position is called "repeatability." In addition because of precision repeatability, the servo/gearbox positioners are very expensive. For example, large heavy workpiece positioners typically represent 30-40% of the complete robotic welding system cost, which may total $500,000, or more. This high cost of positioners can make financial justification difficult, thereby reducing automation opportunity & cost savings for industries that manufacture large, heavy workpieces. While the servo motor/gearbox positioning machines have very good programmed position repeatability, the cost of these machines far exceeds the precision needed for GMAW welding operations, where the weld joint variability is much greater than the servo motor/gearbox repeatability.

As an alternative to servo motor/gearbox positioners, hydraulic positioners are significantly less expensive, reducing part positioning costs by approximately half, and cutting overall robotic welding system costs by approximately 30%. However, despite the lower cost, hydraulic positioners generally are not used for robotic welding due to the poor repeatability for the programmed positions. This inaccurate repeatability enhances the chance of robotic collision with the part or fixture as a robot approaches or departs from a weld location. It can also compromise optimal specified weld position requirements undermining weld quality. This repeatability deficiency discourages the use of hydraulic positioners for robotic welding. While improved sensors may help robots find the weld joints, poor hydraulic positioner repeatability increases sensor search time, robot collision risk and diminishes weld quality.

Since conventional hydraulic positioners for large and heavy do not have sufficient accuracy and repeatability, this equipment is seldom used for highly precise, automated procedures, such as robotic welding. Therefore, there is a need for improvements to these positioners so as to allow use in automated or robotic applications. Further, there is a need for more cost-effective positioners for use in automated/robotic applications.

Therefore, a primary objective of the present invention is the provision of an improved hydraulic positioner for heavy and large work pieces which can be used in automated and robotic manufacturing operations.

Another objective of the present invention is a provision of an improved hydraulic positioner for heavy and large work pieces which is economical to manufacture, and durable and safe in use.

A further objective of the present invention the provision of a hydraulic positioner having a hard stop safety and hard stop location feature which is functional at all times.

Another objective of the present invention is a provision of a hydraulic positioner having preprogrammed work points with a minimum variation repeatability range for elevation and rotation.

Still another objective of the present invention is a hydraulic positioner which utilizes absolute encoders for all positioner axes, so as to allow all axes to recover immediately from power outages, without recalibration.

Yet another objective of the present invention is the provision of hydraulic positioner having improved fine motion control and position information, to allow a control system to make subtle position adjustments that assure reliable, controlled landing on a carriage hard stop.

These and other objectives become apparent from the following description of the invention

SUMMARY OF THE INVENTION

The hydraulic positioner of the present invention has significant improvements to allow raising, lowering and rotation of heavy or large work pieces in an automated or robotic manufacturing process. The positioner includes first and second vertical columns with internal hydraulic cylinders therein, and first and second carriages movable along the columns via actuation of the cylinders. A rotatable headstock is provided on the first carriage and a non-powered rotatable tailstock is provided on the second carriage. The headstock and tailstock are adapted to support the workpiece. Each carriage includes a plurality of teeth, and each column has a hinged stop plate or member controlled by a solenoid so as to engage one of the teeth after the workpiece is positioned, and thereby provide a hard stop to retain the respective carriage at the programmed height along the column. Each hydraulic cylinder elevating and descent axis includes a linear absolute encoder. Each hydraulic cylinder also includes a dynamic electronic proportional control valve. The headstock and tailstock each include a non-contact rotary encoder to sense the position of the respective headstock via a position window on the respective carriage or rotator. The positioners are operatively controlled with a PLC or robot controller with appropriate hardware and software to preprogram a plurality of hard stop positions for the headstock and tailstock.

In operation, the workpiece/fixture is secured to the headstock and tailstock while the head stock and tailstock are in a home position. The PLC or robot control then actuates the hydraulic cylinders of the headstock carriage and tailstock carriage until one of the teeth on each carriage is slightly above the pre-programmed hard stop position for the respective carriage. The PLC or robot control then descends to the stop member into the vertical path of the carriage tooth. The carriage is then lowered so that the tooth rests on top of the stop member, which positively locates the fixture workpiece load &) precludes accidental dropping of the carriage in the event of a hydraulic failure. The headstock and tailstock are independently movable along the respective columns, and about their center rotational axes. The new and improved hydraulic and control system techniques provide better position control and programmed position repeatability, thereby allowing technically effective and economically advantageous hydraulic positioners to be used for many large, heavy part robotic welding applications, while minimizing the risk of robot collisions. Improved positioner repeatability keeps the robot sensor search window small, thereby minimizing sensor search time.

The new hydraulic positioner utilizes several features for improved technical utility for manufacturing operations, such as robotic welding, including:

A. Introducing electronic proportional control valves (EPCV) for simultaneous control of each positioner axis;

B. Integrating non-contact absolute linear or rotary encoder position features for each positioner axis, thereby improving programmed position repeatability;

C. The headstock and tailstock axis elevation program positions feature a controlled dissent to a failsafe mechanical hard stop for each programmed position, thereby improving programmed position repeatability;

D. Improved position repeatability reduces potential for robotic collisions with the part and fixtures being welded;

E. Improved position repeatability reduces robot sensor search time, thereby increasing productivity; and F. Improved positional control and programmed point repeatability ensures welds are performed in specification prescribed positions.

G. Lower-cost hydraulic positioners improve return on investment, thereby broadening the implementation of robotic automation efficiencies and cost savings.

DETAILED DESCRIPTION OF THE PREFERRED EMBODIMENTS

Figure 1:
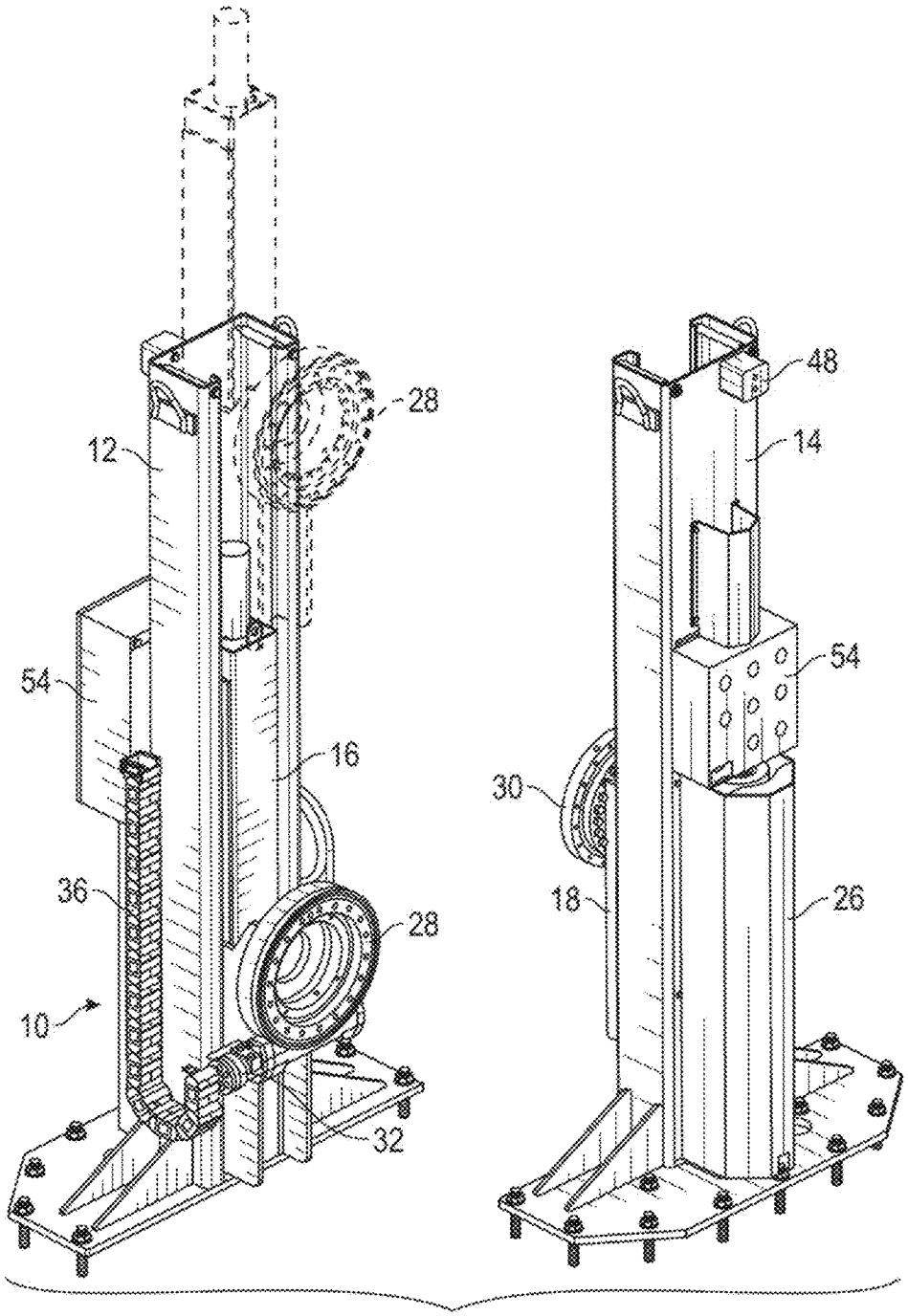
FIG. 1 is a perspective view showing the hydraulic positioner of the present invention, including the master headstock column and the slave tailstock column, with the headstock shown in a solid line lowered position and a broken line raised position.
Figure 2:
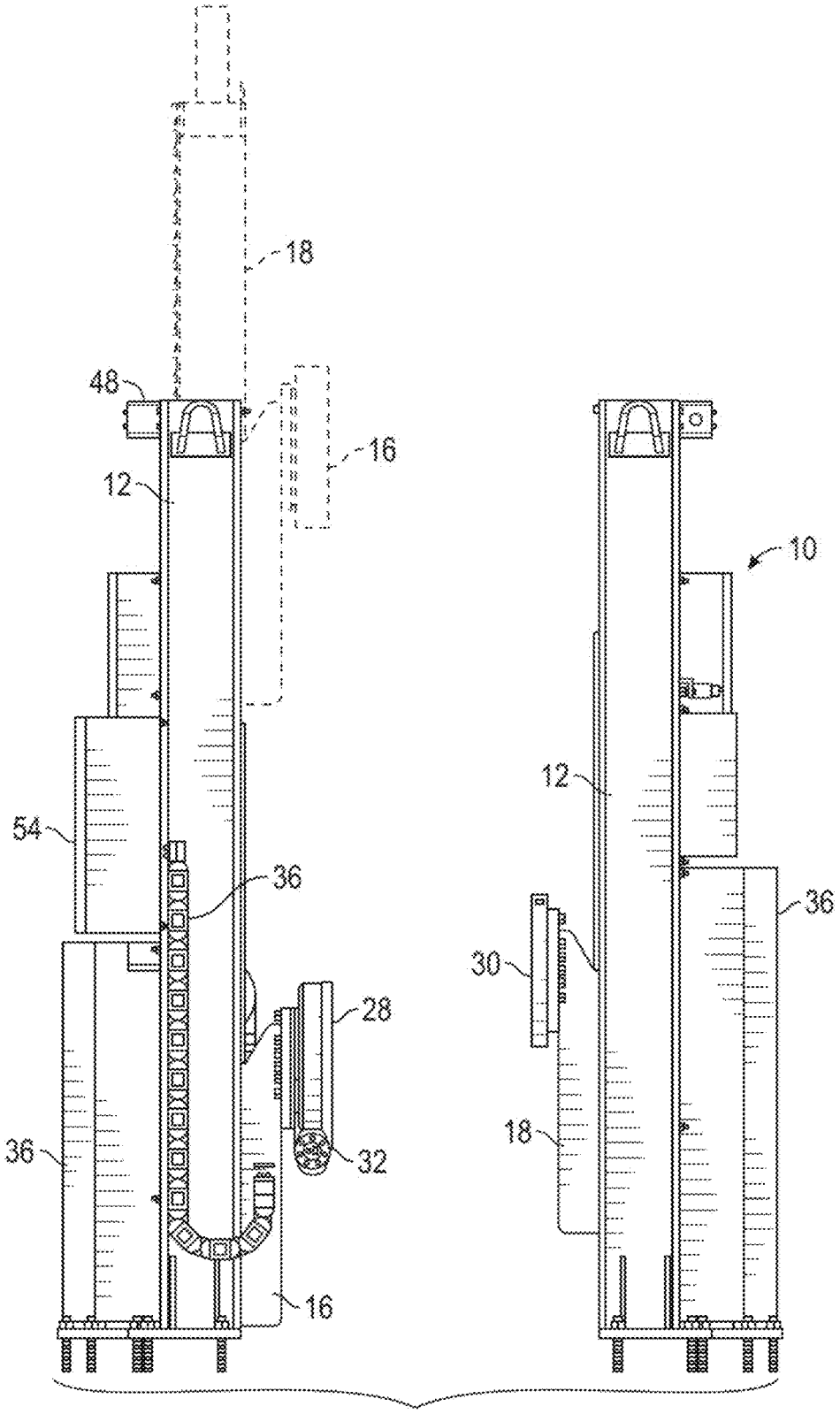
FIG. 2 is the side elevation view of the positioner columns.
Figure 3:
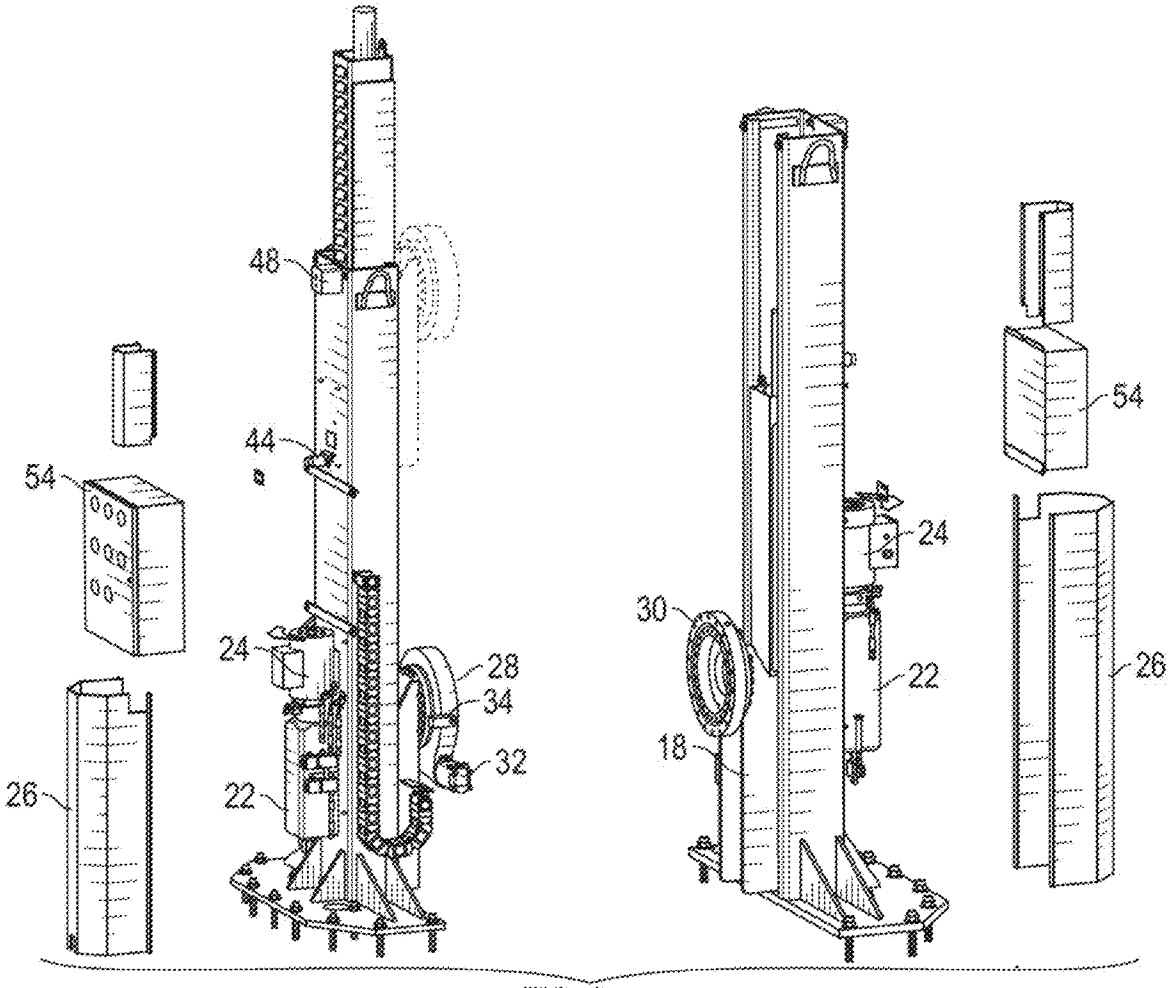
FIG. 3 is a partially exploded view of the positioner columns.
Figure 4:
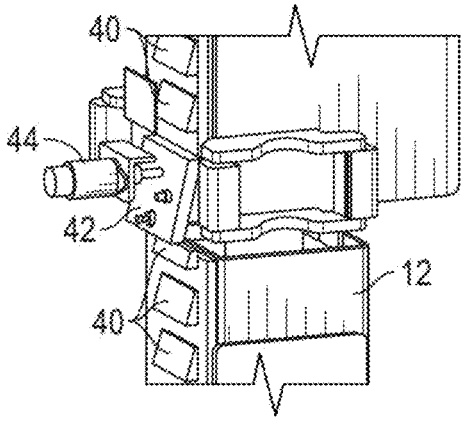
FIG. 4 is an enlarged view showing the hard stop components on the headstock column.

The hydraulic positioner of the present invention is generally designated by the reference numeral 10 in the drawings. The positioner 10 includes a headstock column 12 and a tailstock column 14 which are spaced apart so as to receive a workpiece (not shown) between the columns. The headstock column 12 includes a headstock carriage 16, and the tailstock column 14 includes a tailstock carriage 18. Each carriage 16, 18 can be raised and lowered by a hydraulic cylinder 20 mounted within the respective column 12, 14. A fluid reservoir 22 and a hydraulic motor pump 24 is provided on each column 12, 14 for moving the carriages 16, 18. A cover 26 detachably mounts to each column 12, 14 so as to enclose the reservoir 22 and pump 24.

A headstock 28 is rotatably mounted on the headstock carriage 16, and a tailstock 30 is rotatably mounted on the tailstock carriage 18. A hydraulic motor 32 is provided for each of the headstock 28 and tailstock 30 for rotation in clockwise and counterclockwise directions. The headstock 28 and tailstock 30 each include a mounting plate with a slew bearing and a rotary hydraulic slew drive 32 with a self-locking worm drive. A limit switch 34 is operatively connected to each of the headstock 28 and tailstock 30. A flex chain 38 is also provided on each of the columns 12, 14 for management of the various cables of the positioner 10.

The above description of the positioner 10 is conventional.

Figure 5:
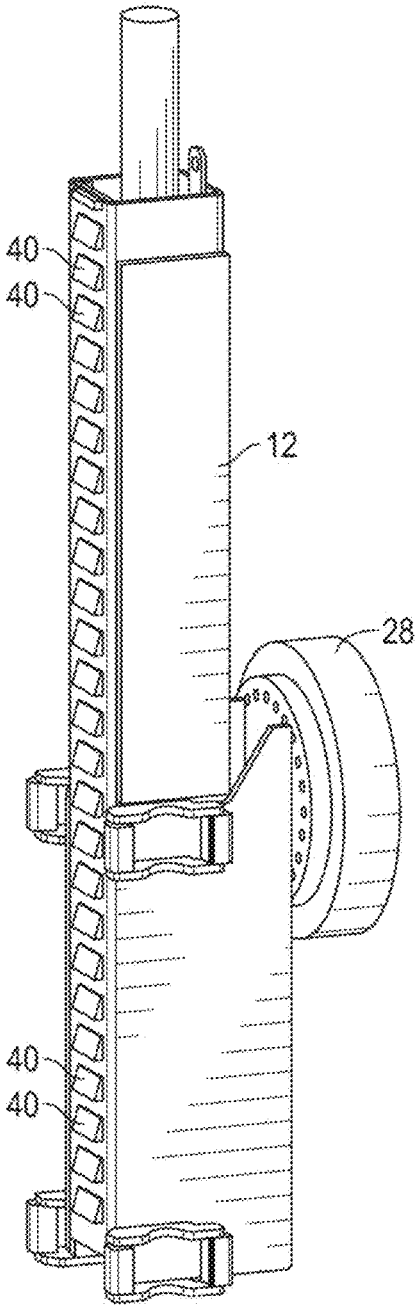
FIG. 5 is a perspective view of the headstock carriage.
Figure 6:
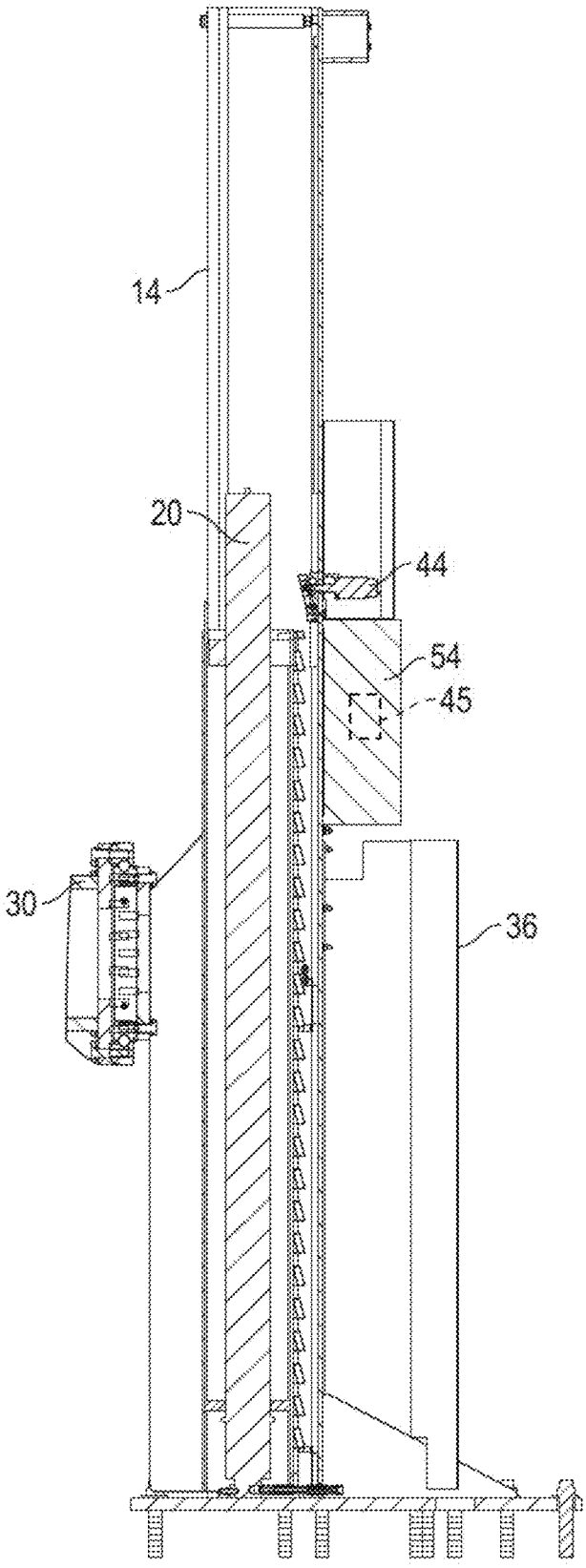
FIG. 6 is a sectional view of one of the columns showing the internal hydraulic cylinder.

One novel feature of the positioner 10 is the provision of a hard stop for all programmed positions for improved repeatability. More particularly, the hard stop system includes a plurality of teeth 40 on each column 12, 14, as best shown in FIG. 5. A plate 42 is hinged to each column. A solenoid 44 is operatively connected to each hinge plate 42 and to the PLC (programmable logic controller) 45 (FIG. 6) inside the control panel 54 mounted on the tower 12 of the positioner 10.

Figure 7:
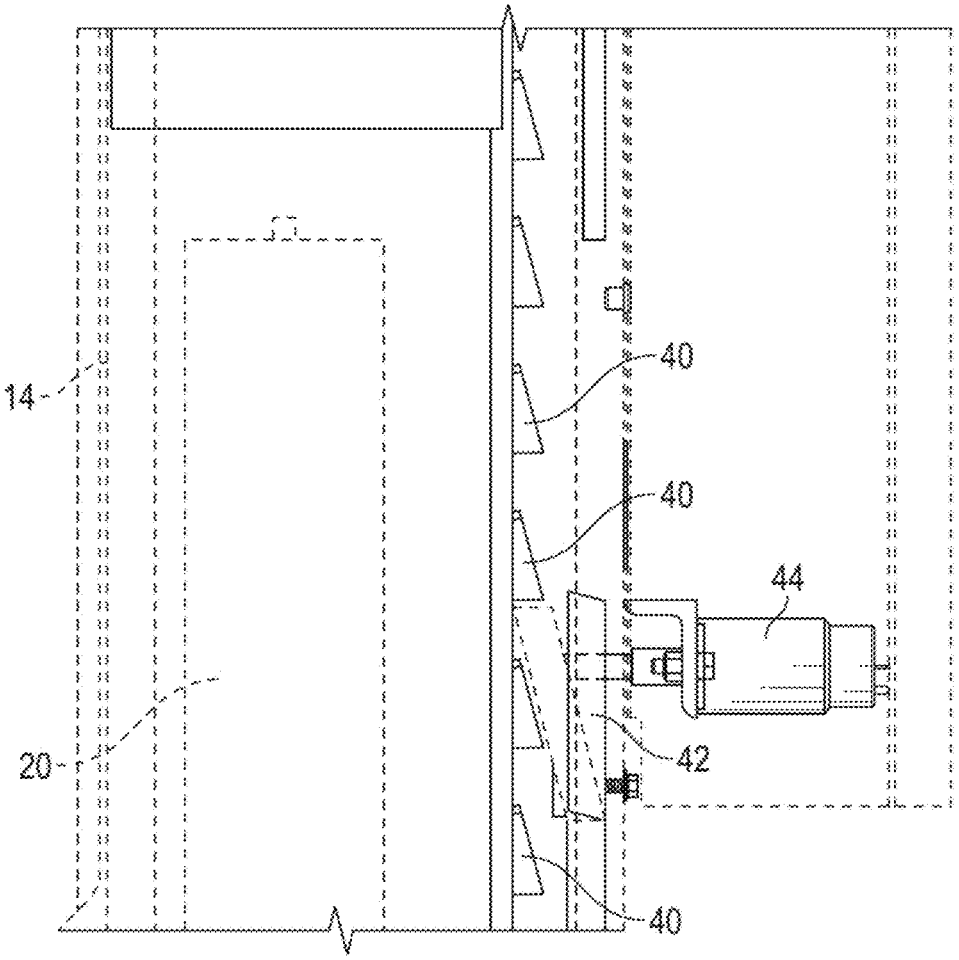
FIG. 7 is an enlarged view showing the stop plate in a retracted position and an extended position.
Figures 8A, 8B, 8C, 8D:
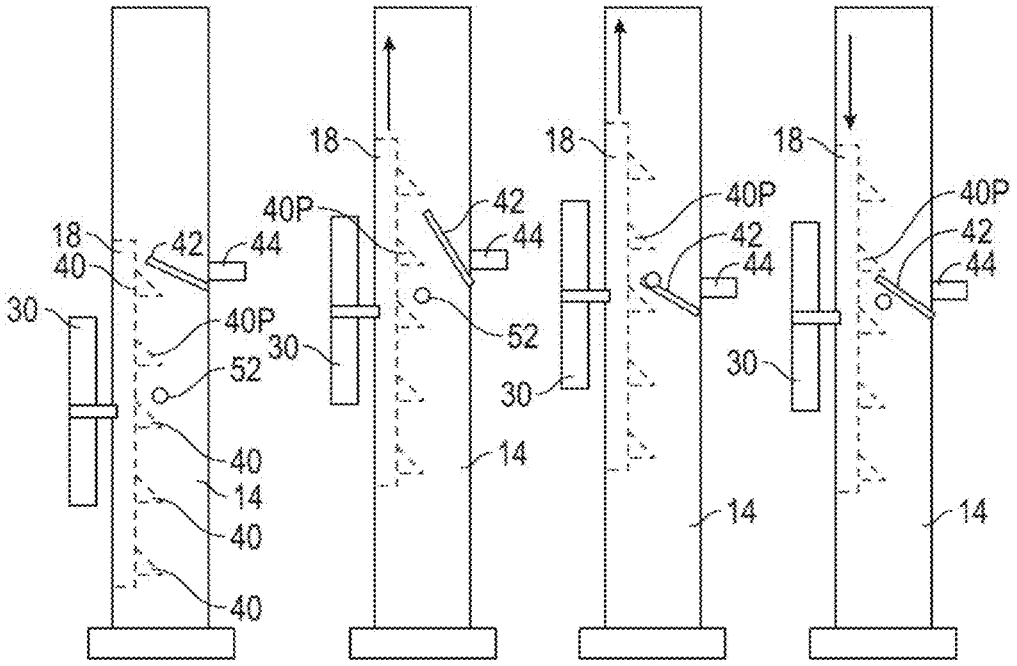
FIGS. 8A-8D are schematic side elevation views showing the tailstock carriage in various elevated positions.

In the preferred embodiment, adjacent teeth are spaced approximately 2.5 inches apart. Before one of the carriages 16, 18 is raised from a lowered home position, the PLC actuates the solenoid to 44 to retract the hinged plate 42 out of the path of the teeth, as shown in solid lines in FIG. 7. The carriage 16 and/or 18 is then raised to a position so that the tooth associated with the programmed position is slightly above the hinge plate 42. The solenoid 44 is then actuated to pivot or extend the plate 42 beneath the program position tooth, as shown in broken lines in FIG. 7. The carriage 16, 18 is then lowered such that the tooth engages the hinged plate 42, thereby creating a hard stop for the carriage 16, 18. In order to lower the carriage 16, 18, the process is reversed. The carriage 16, 18 is raised sufficiently so that the solenoid can retract the hinged plate 42 from the programmed position tooth, and then the carriage can be lowered in a controlled manner by the hydraulic cylinder 20.

Another unique feature of the present invention is the utilization of electronic proportional control valves 46 in the hydraulic fluid circuitry, which provide improved motion control and repeatability. The control valves 46 replaces conventional low and high-volume fluid valves.

A further new feature of the present invention is the use of linear, non-contact, absolute encoders 48 in conjunction with the carriage elevation axes. These encoders 48 have magnetostrictive position sensing.

The combined benefits of the proportional control valves 46 and the absolute encoders 48 provide positional data and the motion control necessary to implement the hard stop feature while eliminating vertical location variability of the headstock 16 and the tailstock 18.

Another improved feature for the positioner 10 is the utilization of rotary non-contact, absolute encoders 50 in close proximity and adjacent to the slew drive face plate and fixture mounting plate of the headstock 28 and tailstock 30. These encoders for the rotary axes improve the rotary axis repeatability from +/−0.250 inch to +/−0.030 inch.

The absolute encoders 46, 48 for all positioner axes allow each axis to immediately recover from power outages without recalibration. For the elevation axes of the carriages 16, 18, the combined improved fine motion control and improved position information allows the control system to make subtle position adjustments that assure reliable, controlled landing on the hard stop teeth 40. Locating the elevating axis to the hard stop teeth improves machine and operator safety.

In operation, the headstock 28 and tailstock 30 can be independently elevated to different programmed positions so as to provide an angular tilt to the workpiece supported between the headstock and tailstock. The headstock 28 and tailstock 30 can also be rotated in unison in either the clockwise or account counterclockwise directions so as to rotate the workpiece.

FIGS. 6A-6D schematically illustrate operation of one of the column 14, with operation of the column 12 being the same. The carriage 18 starts in a lowered home position, as shown in FIG. 6A. The tooth labeled 40P corresponds to the desired program position for the carriage. As the carriage rises (FIG. 6B), the teeth 40 push the hinge plate 42 upwardly for clearance. As the hinge plate 42 passes each tooth 40, the hinge drops back into a safety position beneath the adjacent upper tooth. When they linear encoder 48 senses the count window 52 on the carriage, the PLC terminates extension of the cylinder so that the hinge plate 42 is positioned beneath the target position tooth 40P (FIG. 6C). The PLC then causes the cylinder to retract, thereby lowering the carriage until the target tooth 40P engages the plate 42 for a hard stop with the carriage in the desired programmed position (FIG. 6D).

Figure 9:
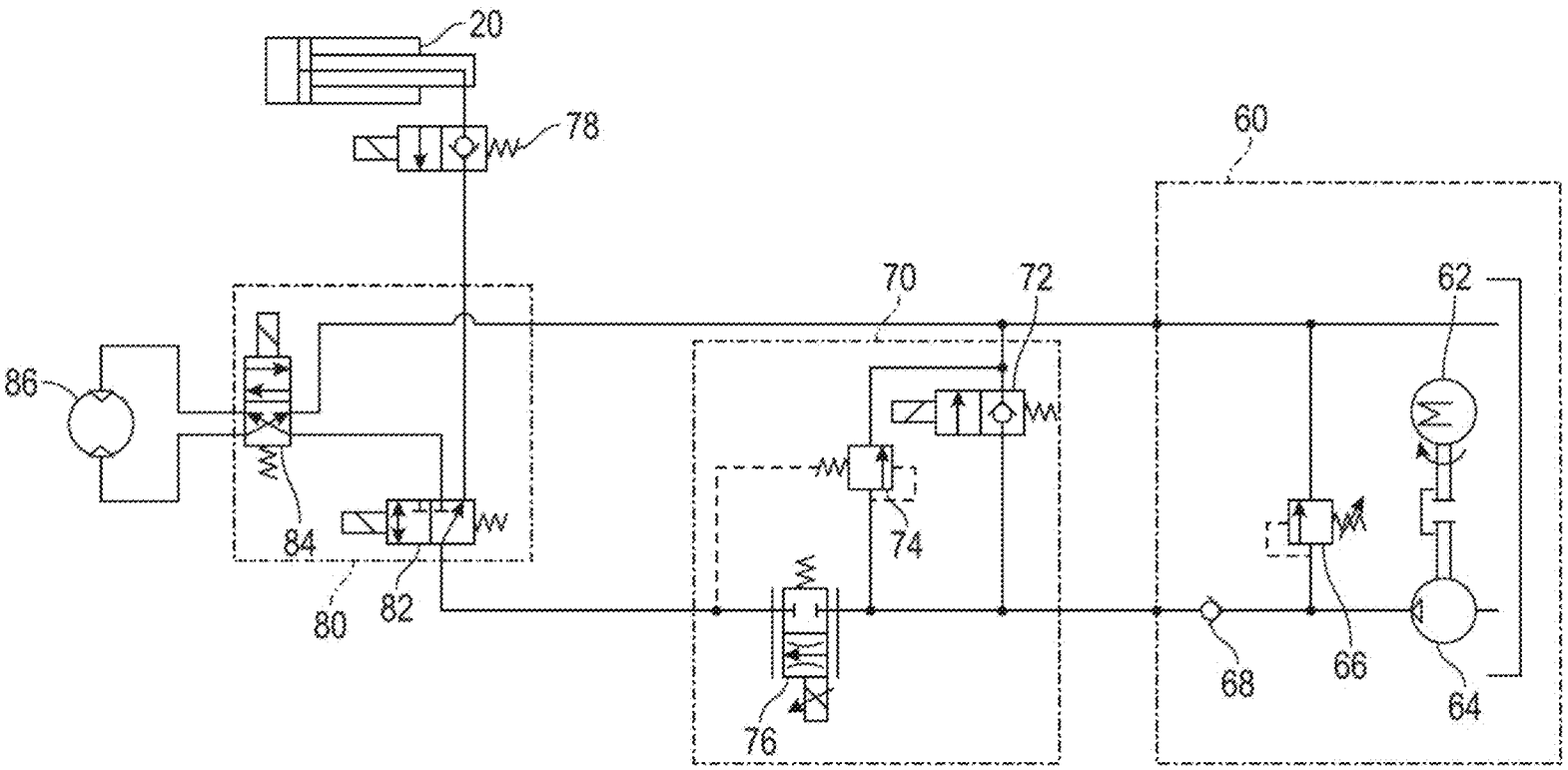
FIG. 9 is a hydraulic schematic for the headstock.
Figure 10:
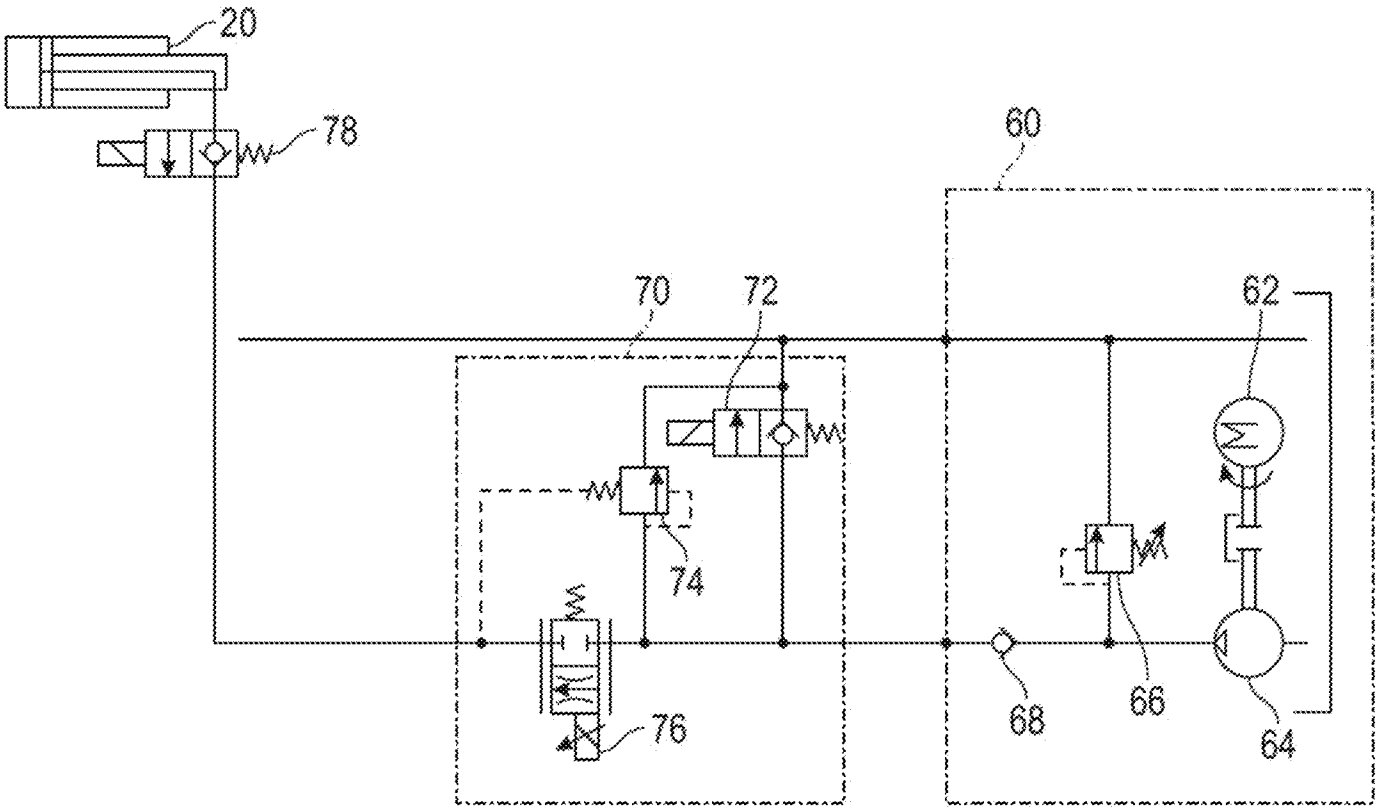
FIG. 10 is a hydraulic skematic for the tailstock.

FIGS. 9 and 10 show the hydraulic circuitry for the headstock and tailstock, respectfully. This circuitry allows the utilization of cost effective fixed displacement hydraulic power units for the positioner, while introducing an external electro-proportional flow valve to fine tune the hydraulic flow rates for the extension and retraction of the vertical hydraulic cylinders and for rotation of the hydraulic motors in the columns. The flow control valve will be controlled by a proportional valve amplifier, which interprets a 0-10 VDC and a log command signal from the PLC and control electrical power to the proportional solenoid coil via a 4-20 mA command signal. The amplifier also provides the capability of programming ramp-up and ramp-down features, as needed. By pairing this hydraulic circuitry with the linear position feedback into the PLC, the headstock and tailstock vertical powered elevation speed and gravity can be independently controlled. This improved programmed location control provides for more precision movement of the work piece.

More particularly, the hydraulic circuitry for the head stock and tail stock both include a hydraulic unit component 60 including an electric motor 62, a gear pump 64, a relief valve 66, and a check valve 68. Each of the headstock and tailstock hydraulic circuits also includes an electro-proportional flow manifold 70 having a two-way, normally closed valve 72, a bypass valve 74, and a proportional throttling, normally closed valve 76. The circuitry for the headstock also includes a directional control manifold 80, having a 3-way, 2-position valve 82 and a 4-way, 2-position valve 84, which is not present in the tailstock circuitry. A 2-way, normally closed valve 78 is also provided for each of the hydraulic cylinders 20 in the headstock and tailstock.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A positioner for raising, lowering and rotating a work piece, comprising: a first vertical column and a first carriage movable along the column; a second vertical column and a second carriage movable along the second column; first and second linear actuators operatively connected to the first and second carriages, respectively, to move the carriages along the columns;

a PLC to control movement of the carriages along the columns, and having control software with a plurality of preprogrammed positions for the headstock and tail stock;

a rotatable headstock on the first carriage; a rotatable tailstock on the second carriage;

the first carriage having a plurality of teeth, with each of the teeth corresponding to one of the preprogrammed positions; and the first column having a stop member to engage one of the teeth to retain the first carriage at a selected position on the first column.

2. The positioner of claim 1 further comprising a rotary encoder on the headstock.

3. The positioner of claim 2 wherein the rotary encoder is non-contact.

4. The positioner of claim 1 wherein the linear actuators are single acting hydraulic cylinders.

5. The positioner of claim 4 wherein each hydraulic cylinder includes a dynamic electronic proportional control valve.

6. The positioner of claim 5 wherein each hydraulic cylinder includes a linear absolute encoder.

7. The positioner of claim 4 wherein each hydraulic cylinder includes a linear absolute encoder.

8. The positioner of claim 1 wherein the stop member is a hinged plate.

9. The positioner of claim 1 wherein the head stock and tail stock are independently movable.

10. The positioner of claim 9 wherein the stop member includes a solenoid to retract the plate from a stop position engaging one of the teeth.

11. The positioner of claim 1 further comprising encoders on the carriages to verify positions of the headstock and tailstock.

12. The positioner of claim 1 wherein each carriage includes a position window and an encoder to sense the position of the respective head stock and tail stock via the position window.

13. The positioner of claim 1 wherein the second column has a stop member to engage one of the teeth to retain the second carriage in a selected position.

14. A method of positioning a headstock and a tailstock on a first and second columns, respectively, to hold a work piece for a manufacturing process, comprising:

setting the headstock and tailstock in a home position;

raising a carriage supporting one of the headstock and tailstock until a tooth member on the carriage representing a pre-programmed hard stop position passes a stop member on one of the columns supporting the carriage;

moving the stop member into a vertical path of the tooth; and then lowering the carriage until the tooth engages the stop member.

15. The method of claim 14 further comprising rotating the work piece about axes on the head stock and the tail stock.

16. The method of claim 14 further comprising verifying the pre-programmed hard stop position using an encoder.

17. The method of claim 14 further comprising controlling raising and lowering of the carriage with PLC software having a plurality of hard stop positions.

18. The method of claim 14 further comprising controlling raising and lowering with a hydraulic cylinder having a dynamic electronic proportional control valve.

19. The method of claim 14 further comprising controlling raising and lowering with a hydraulic cylinder having a linear absolute encoder.

20. The method of claim 14 further comprising independently raising and lowering the headstock and tailstock.

* * * * *